US011428188B1

(12) United States Patent
Kim et al.

(10) Patent No.: US 11,428,188 B1
(45) Date of Patent: Aug. 30, 2022

(54) UNCLOGGING OF DUCTS FOR FUEL INJECTION

(71) Applicant: Caterpillar Inc., Peoria, IL (US)

(72) Inventors: Charlie Chang-Won Kim, Dunlap, IL (US); Kenth I. Svensson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/305,212

(22) Filed: Jul. 1, 2021

(51) Int. Cl.

| | |
|---|---|
| ***F02D 41/40*** | (2006.01) |
| ***F02D 41/00*** | (2006.01) |
| ***F02M 65/00*** | (2006.01) |
| ***F02D 41/38*** | (2006.01) |
| ***F02D 13/02*** | (2006.01) |
| ***F02D 35/02*** | (2006.01) |

(52) U.S. Cl.
CPC ..... *F02D 41/401* (2013.01); *F02D 13/0215* (2013.01); *F02D 35/023* (2013.01); *F02D 41/0055* (2013.01); *F02D 41/0077* (2013.01); *F02D 41/3836* (2013.01); *F02M 65/008* (2013.01)

(58) Field of Classification Search
CPC .. F02D 41/401; F02D 13/0215; F02D 35/023; F02D 41/0055; F02D 41/0077; F02D 41/3836; F02M 65/008
See application file for complete search history.

(56) References Cited

U.S. PATENT DOCUMENTS

| | | | | |
|---|---|---|---|---|
| 5,915,352 | A * | 6/1999 | Okamoto | F02M 65/008 123/298 |
| 6,705,329 | B1 | 3/2004 | Usui | |
| 9,593,616 | B2 | 3/2017 | Amano | |
| 9,719,440 | B2 | 8/2017 | Nishizawa et al. | |
| 10,012,196 | B1 | 7/2018 | Qi et al. | |
| 10,975,796 | B2 * | 4/2021 | Ueno | F02D 41/3005 |
| 2003/0226399 | A1 * | 12/2003 | Clingerman | H01M 8/04686 73/114.53 |
| 2009/0312941 | A1 * | 12/2009 | Wang | F02D 35/023 701/114 |
| 2012/0191325 | A1 * | 7/2012 | Haskara | F02D 35/023 701/104 |
| 2012/0204833 | A1 | 8/2012 | Yonemoto et al. | |
| 2020/0240349 | A1 * | 7/2020 | Ueno | F02D 41/402 |

FOREIGN PATENT DOCUMENTS

| | | | | |
|---|---|---|---|---|
| DE | 102005034449 A1 * | 1/2007 | | F02D 41/221 |

OTHER PUBLICATIONS

English translation of DE102005034449A1. (Year: 2021).*

* cited by examiner

*Primary Examiner* — Joseph J Dallo
(74) *Attorney, Agent, or Firm* — Harrity & Harrity LLP

(57) ABSTRACT

A controller may obtain data indicative of heat release in a cylinder of an engine. The controller may determine that the data indicative of the heat release in the cylinder is indicative of clogging of one or more ducts of a duct structure of the engine. The controller may perform an operation to reduce the clogging of the one or more ducts based on the data indicative of the heat release in the cylinder being indicative of the clogging of the one or more ducts. The operation may include at least one of causing a pressure of fuel that is supplied to a fuel injector to increase or causing a peak temperature in the cylinder to increase.

20 Claims, 4 Drawing Sheets

UNCLOGGING OF DUCTS FOR FUEL INJECTION

TECHNICAL FIELD

The present disclosure relates generally to ducted fuel injection and, for example, to unclogging of ducts used for fuel injection.

BACKGROUND

Combustion engines may include one or more cylinders. A cylinder head of a cylinder, and a piston associated with the cylinder, may define a combustion chamber therebetween. Fuel for combustion is directly injected into the combustion chamber by, for example, a fuel injector that is associated with the cylinder. For example, the fuel injector has at least one orifice for fuel discharge directly into the combustion chamber.

Different mixtures and/or equivalence ratios of a fuel/air mixture may produce different results during combustion. A manner in which the injected fuel mixes and/or interacts with air and other environmental elements of the combustion chamber may impact the combustion process and associated emissions. Furthermore, if fuel and air mixing is inadequate, then increased amounts of soot may form within the combustion chamber.

In some cases, an engine may utilize ducted fuel injection to improve fuel and air mixing. In ducted fuel injection, a duct structure is disposed in the cylinder, and the duct structure may include at least one duct configured to provide a passage for a fuel jet discharged from the fuel injector into the combustion chamber. However, incomplete combustion residuals may also form within the duct (e.g., due to prolonged idling of the engine), thereby leading to clogging of the duct with fuel, soot, or the like. Clogging of the duct may decrease engine power, increase emissions, and increase combustion variability. Moreover, clogging of the duct may increase soot formation, thereby exacerbating the aforementioned effects.

U.S. Patent Application Publication No. 20120204833 (the '833 publication) discloses a fuel injection device that includes a fuel supply pump, a common rail, an injector, a filter, and an electronic control unit (ECU). The '833 publication indicates that the filter is arranged upstream of the fuel supply pump to remove foreign material contained in the fuel, and that the common rail is connected to a discharge port of the fuel supply pump via a high-pressure pipe. The '833 publication discloses that the ECU is configured to determine whether the filter is clogged with wax, and to command an introduction valve to introduce high-pressure fuel into the high-pressure pipe when the filter wax-clogging is determined. The fuel injection device of the '833 publication does not use ducted fuel injection, and therefore, the '833 publication does not address detecting a clogged duct or remediating a clogged duct.

The duct unclogging system of the present disclosure solves one or more of the problems set forth above and/or other problems in the art.

SUMMARY

A system includes a fuel injector of an engine, the fuel injector having one or more orifices to discharge fuel; a duct structure including one or more ducts configured to provide respective passages for fuel discharged from the one or more orifices of the fuel injector to a cylinder of the engine; and a controller configured to: obtain data indicative of heat release in the cylinder; determine that one or more metrics associated with the data indicative of the heat release in the cylinder satisfy a threshold; and perform an operation to reduce clogging of the one or more ducts based on the one or more metrics satisfying the threshold, the operation including at least one of causing a pressure of fuel that is supplied to the fuel injector to increase, or causing a peak temperature in the cylinder to increase.

A method includes obtaining, by a controller, data indicative of heat release in a cylinder of an engine, the engine including a fuel injector having one or more orifices to discharge fuel, and a duct structure including one or more ducts configured to provide respective passages for fuel discharged from the one or more orifices of the fuel injector to the cylinder of the engine; determining, by the controller, that the data indicative of the heat release in the cylinder is indicative of clogging of the one or more ducts; and performing, by the controller, an operation to reduce the clogging of the one or more ducts based on the data indicative of the heat release in the cylinder being indicative of the clogging of the one or more ducts, the operation including at least one of causing a pressure of fuel that is supplied to the fuel injector to increase, or causing a peak temperature in the cylinder to increase.

A machine includes an engine including a cylinder; a fuel injection system including a fuel injector having one or more orifices to discharge fuel; a duct structure, disposed in the cylinder, including one or more ducts configured to provide respective passages for fuel discharged from the one or more orifices of the fuel injector to the cylinder; and a controller configured to: obtain data indicative of heat release in the cylinder; determine that the data indicative of the heat release in the cylinder is indicative of clogging of the one or more ducts; and perform an operation to reduce the clogging of the one or more ducts based on the data indicative of the heat release in the cylinder being indicative of the clogging of the one or more ducts, the operation including causing a pressure of fuel that is supplied to the fuel injector to increase, or causing a peak temperature in the cylinder to increase.

DETAILED DESCRIPTION

This disclosure relates to a duct unclogging system, which is applicable to any machine that utilizes an internal combustion engine. For example, the machine may be a vehicle, a compactor machine, a paving machine, a cold planer, a grading machine, a backhoe loader, a wheel loader, a harvester, an excavator, a motor grader, a skid steer loader, a tractor, a dozer, an engine-driven generator (e.g., a genset), a marine propulsion system, or the like.

Figure 1:
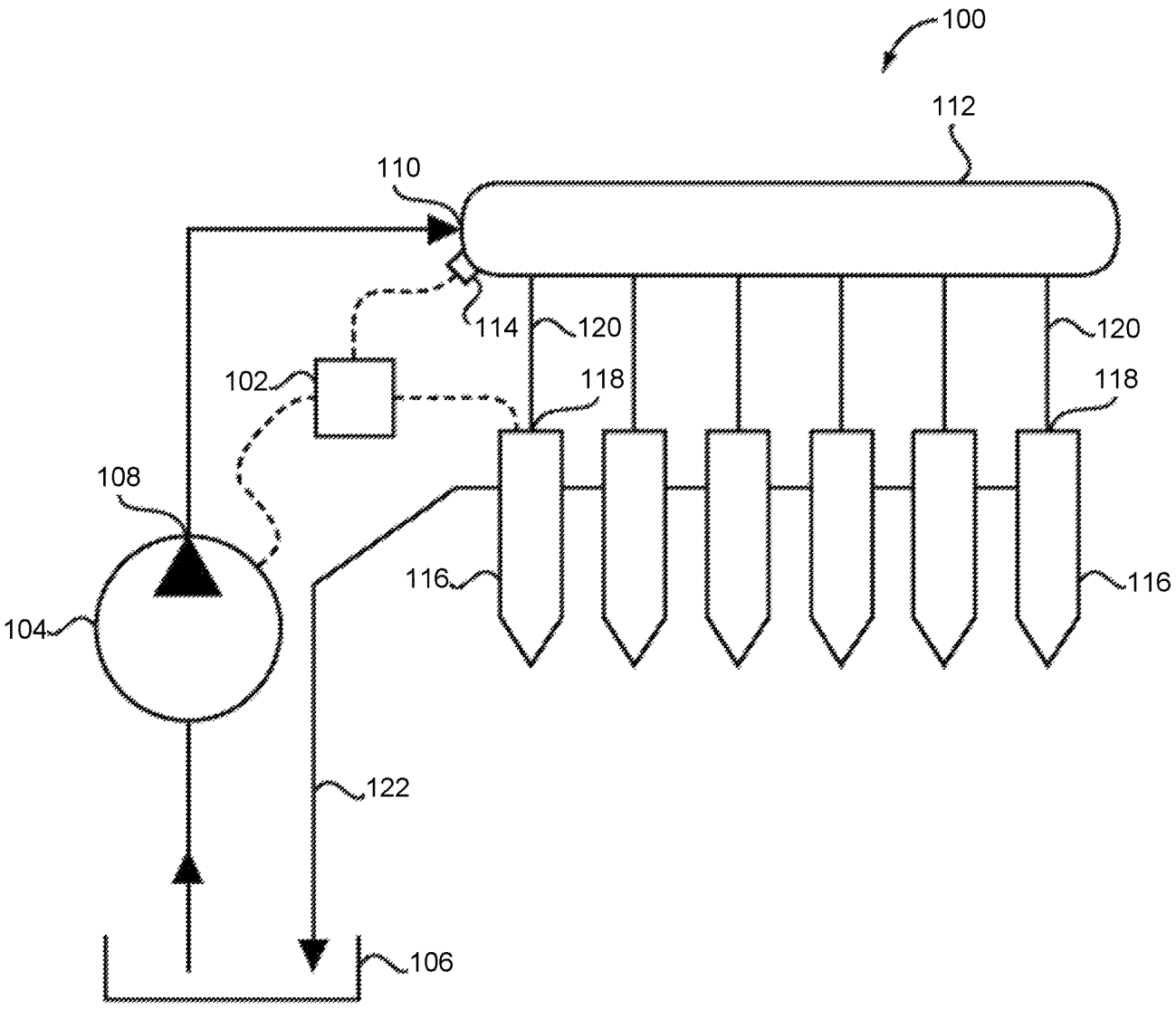
FIG. 1 is a diagram of an example fuel injection system described herein.

FIG. 1 is a diagram of an example fuel injection system 100 described herein. The fuel injection system 100 is depicted as a common rail fuel injection system; however, the fuel injection system 100 may also employ other configurations. For example, the fuel injection system 100 may be configured for use of unit injectors. The fuel injection system 100 may be used with an engine (e.g., engine 200, shown in FIG. 2) of a machine (not shown). For example, the engine may be an internal combustion engine, such as a diesel engine, a gasoline engine, or the like.

The fuel injection system 100 includes a controller 102 configured to control various operations of the fuel injection system 100, as described herein. The controller 102 (e.g., an electronic control module (ECM)) may include one or more memories and one or more processors that implement operations associated with unclogging of ducts used for ducted fuel injection, as described herein.

The fuel injection system 100 includes a fuel pump 104. The fuel pump 104 may be a variable output, high pressure pump. As shown, the fuel pump 104 may be communicatively connected to the controller 102. Accordingly, the controller 102 may provide control signals to the fuel pump 104 that control an output of the fuel pump 104. In one example, the output of the fuel pump 104 may be controlled by the controller 102 via an electronically-controlled throttle inlet valve.

The fuel pump 104 draws fuel from a tank 106. The fuel pump 104 includes an outlet 108 fluidly connected to an inlet 110 of a fuel rail 112 (e.g., a common rail). A pressure sensor 114 may be coupled to the fuel rail 112, and the pressure sensor 114 may be configured to detect a pressure in the fuel rail 112. As shown, the pressure sensor 114 may be communicatively connected to the controller 102. Thus, the controller 102 may monitor the pressure in the fuel rail 112 via the pressure sensor 114. Moreover, the controller 102 may control the pressure in the fuel rail 112 via control of the fuel pump 104.

The fuel injection system 100 includes a plurality of fuel injectors 116. The fuel injectors 116 are respectively associated with a plurality of cylinders of an engine, as described below. For example, the fuel injectors 116 are configured to discharge fuel into respective cylinders (e.g., combustion chambers of the cylinders) of the engine. Although the fuel injection system 100 is depicted with six fuel injectors 116, the fuel injection system 100 may include any quantity of fuel injectors 116. Moreover, although the fuel injection system 100 is depicted with a common fuel rail 112, the fuel injectors 116 may be unit injectors in some examples.

Each fuel injector 116 has an inlet 118 that is connected to the fuel rail 112 by a respective passage 120. Each fuel injector 116 may be communicatively connected to the controller 102 (only one such connection is shown in FIG. 1). The controller 102 may provide control signals to the fuel injectors 116 that control operation of the fuel injectors 116. For example, the control signals provided by the controller 102 may control a timing by which the fuel injectors 116 discharge fuel.

In some examples, the fuel injection system 100 includes a drain line 122. The drain line 122 is configured to return uninjected fuel to the tank 106. For example, the uninjected fuel may be fuel leaked from the fuel injectors 116 into the drain line 122.

As indicated above, FIG. 1 is provided as an example. Other examples may differ from what is described with regard to FIG. 1.

Figure 2:
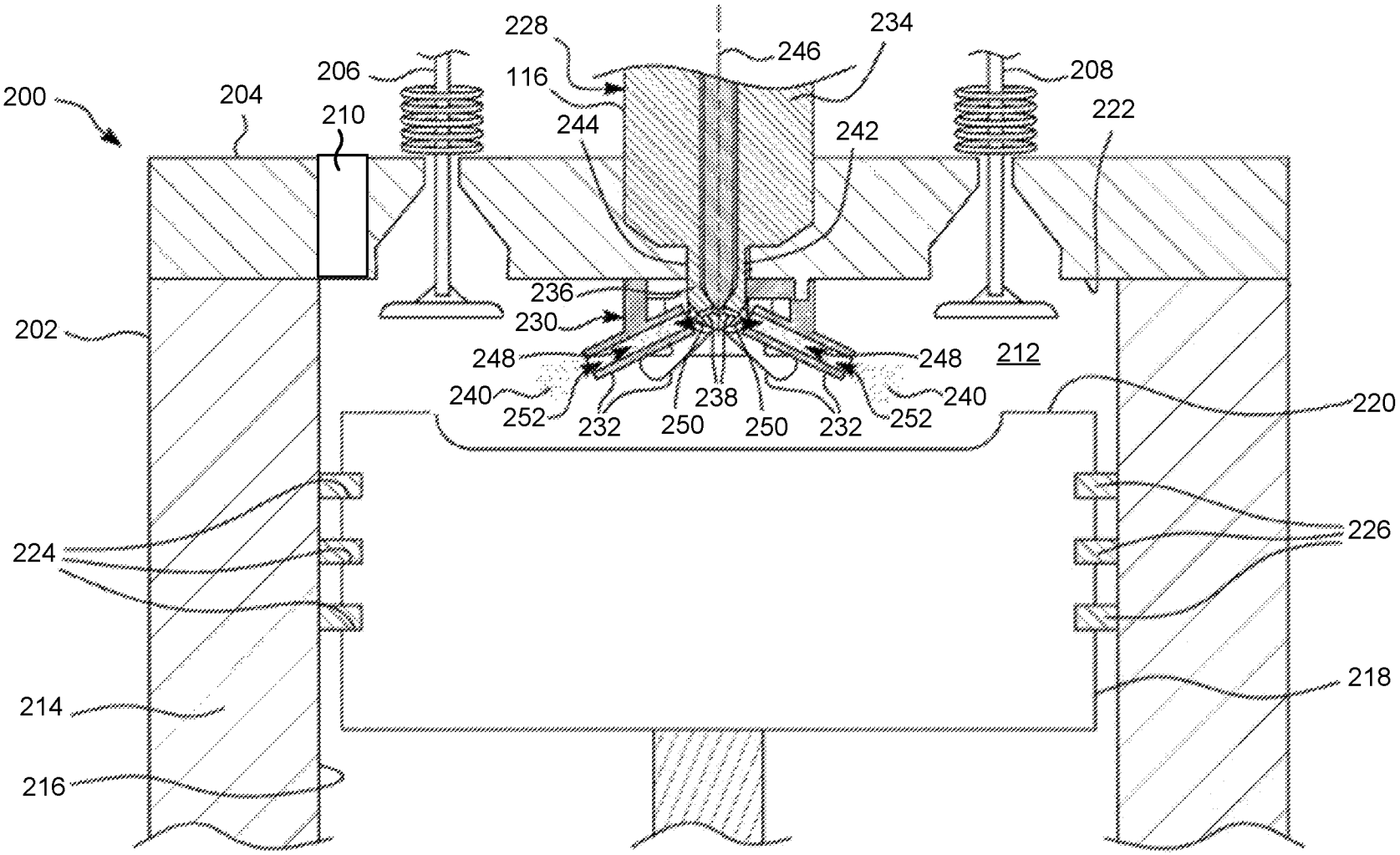
FIG. 2 shows a sectional view of an example engine including a fuel injector assembly having a duct structure described herein.

FIG. 2 shows a sectional view of an example engine 200 including a fuel injector assembly having a duct structure described herein.

As described above, the engine 200 may be an internal combustion engine, such as a diesel engine. The engine 200 includes at least one cylinder 202. A cylinder head 204 is coupled to a first end of the cylinder 202, and a crankcase (not shown) is coupled to a second end of the cylinder 202. The cylinder head 204 may act as a support structure for mounting various other components, such as an intake valve 206, an exhaust valve 208, or the like. In some examples, the cylinder head 204 may include a sensor 210 that is configured to detect a pressure in the cylinder 202. For example, the sensor 210 may include a strain gauge sensor, a piezoelectric sensor, or the like. The cylinder head 204 includes an intake conduit for allowing intake of air/exhaust gases into a combustion chamber 212, and an exhaust conduit for facilitating discharge of exhaust gases from the combustion chamber 212.

The cylinder 202 includes a cylindrical wall 214 that defines a cylinder bore 216 extending from the first end to the second end of the cylinder 202. The engine 200 further includes a piston 218 disposed within the cylinder bore 216. The piston 218 is configured to reciprocate within the cylinder bore 216 between a top dead center (TDC) of the cylinder 202 and a bottom dead center (BDC) of the cylinder 202. The piston 218 includes a piston crown 220 that faces a flame deck surface 222 of the cylinder head 204. The piston 218 may include other structural features, such as a piston bowl to facilitate combustion of a fuel, a plurality of grooves 224 to receive a plurality of piston rings 226, or the like. The combustion chamber 212 is an enclosure in the cylinder bore 216 of the cylinder 202 defined between the flame deck surface 222 and the piston crown 220. That is, the combustion chamber 212 is bound at one end by the flame deck surface 222 of the cylinder head 204 and bound at another end by the piston crown 220 of the piston 218.

The engine 200 includes a fuel injector assembly 228 having a fuel injector 116. The fuel injector 116 may be in fluid communication with the combustion chamber 212 to provide fuel to the combustion chamber 212. A duct structure 230, including a plurality of ducts 232, is disposed within the combustion chamber 212.

The fuel injector 116 is mounted to the cylinder head 204. The fuel injector 116 includes a body 234 having a tip portion 236 protruding within the combustion chamber 212 through the flame deck surface 222. The fuel injector 116 includes a plurality of orifices 238 formed at the tip portion 236 to discharge/inject fuel into the combustion chamber 212 as, for example, a plurality of fuel jets 240. The plurality of fuel jets 240 discharged by the fuel injector 116 are received by the plurality of ducts 232.

Further, the fuel injector 116 includes a mating structure 242 disposed at an outer periphery 244 of the fuel injector 116. As shown, the mating structure 242 may be disposed or formed at the outer periphery 244 of the tip portion 236 of the fuel injector 116. The mating structure 242 may be configured to engage with the duct structure 230 to align the plurality of orifices 238 to the plurality of the ducts 232. That is, each of the plurality of orifices 238 aligns with a corresponding one of the plurality of ducts 232.

The duct structure 230 is coupled (e.g., by bolts, press fitting, a threaded connection, or the like) to the cylinder head 204. The duct structure 230 may be coupled to the cylinder head 204 such that the plurality of ducts 232 are disposed into the combustion chamber 212, and the plurality of ducts 232 are arrayed around a longitudinal axis 246 of the fuel injector 116.

A duct 232 includes a tubular structure that defines a passage 248 of the duct 232 having an inlet opening 250 and an outlet opening 252. To ensure that most of, if not all, of the fuel of each fuel jet 240 enters the corresponding duct 232 upon being injected by the fuel injector 116, an opening width of the inlet opening 250 of each duct 232 may be greater than a width of a corresponding fuel jet width at the inlet opening 250 of the duct 232. As described above, due to formation of incomplete combustion residuals, one or more of the passage 248, the inlet opening 250, or the outlet opening 252, may become clogged.

As indicated above, FIG. 2 is provided as an example. Other examples may differ from what is described with regard to FIG. 2.

Figure 3:
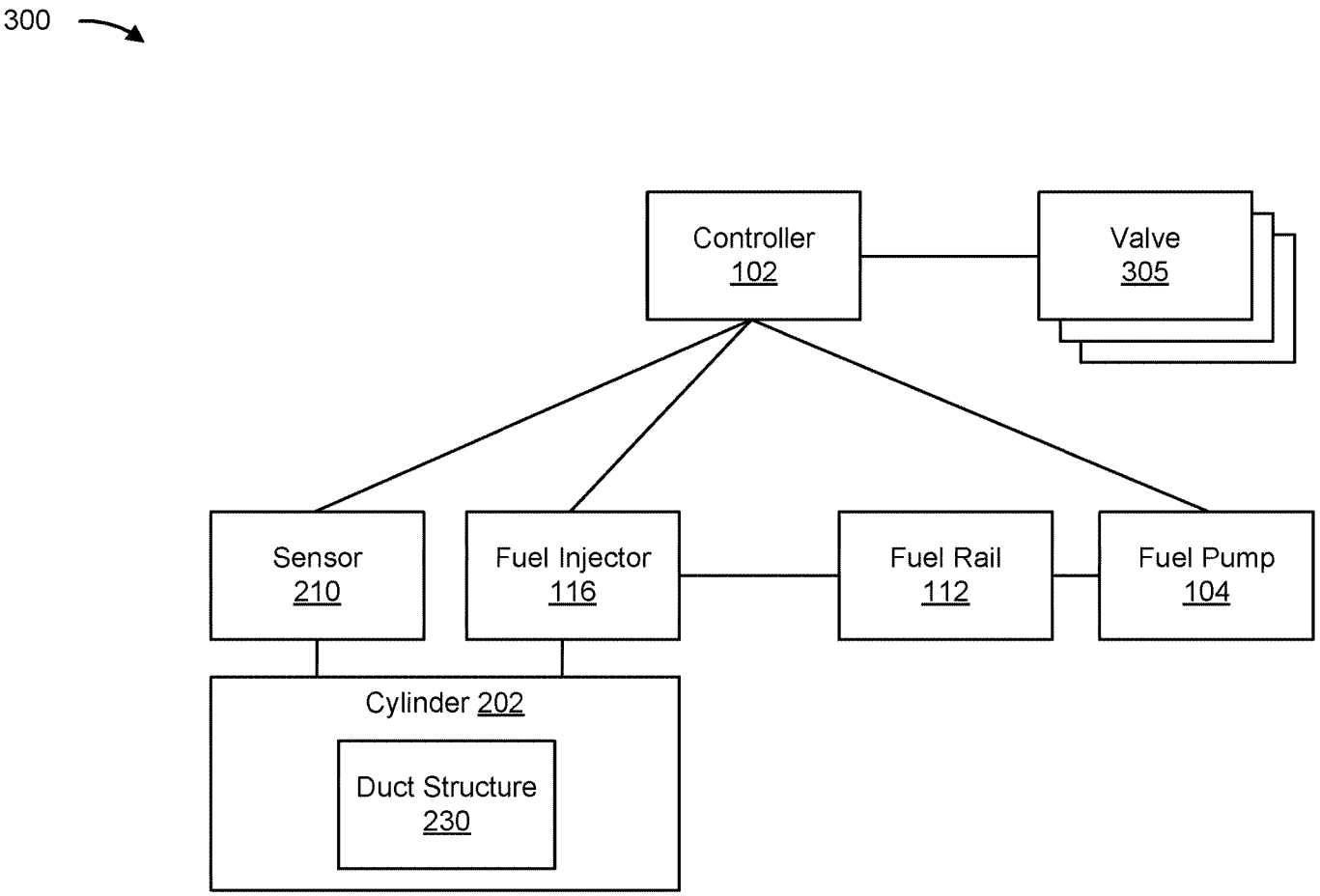
FIG. 3 is a diagram of an example duct unclogging system described herein.

FIG. 3 is a diagram of an example duct unclogging system 300 described herein. The duct unclogging system 300 may include the fuel pump 104, the fuel rail 112, and/or one or more fuel injectors 116 of the fuel injection system 100 of the engine 200, as described above. In some implementations, the duct unclogging system 300 may include one or more valves 305, such as an aftercooler bypass valve, an exhaust gas recirculation (EGR) cooler bypass valve, an EGR control valve, an intake valve (e.g., the intake valve 206), an exhaust value (e.g., the exhaust valve 208), or the like. An aftercooler is configured to cool compressed air that is supplied (e.g., by a compressor of a turbocharger) to an intake manifold of the engine 200. Thus, bypass of the aftercooler via an aftercooler bypass valve 305 may increase the temperature of air supplied to the engine 200. An EGR system is configured to recirculate a portion of exhaust gas exiting the engine 200 back to the cylinders 202 of the engine 200 to provide gases inert to combustion for absorbing combustion heat and reducing in-cylinder temperatures. Thus, reduction or cessation of EGR via an EGR control valve 305 may increase combustion temperatures. Moreover, the EGR system may include a cooler (e.g., a heat exchanger) configured to cool exhaust gas that is recirculated. Thus, bypass of the EGR cooler via an EGR cooler bypass valve 305 may increase the temperature of exhaust gas and thereby increase in-cylinder temperatures.

The duct unclogging system 300 may include one or more cylinders 202 of the engine 200, as described above. For example, each cylinder 202 may be configured to receive a fuel discharge from a respective fuel injector 116. The duct unclogging system 300 may include one or more duct structures 230 (e.g., each including one or more ducts 232) and/or one or more sensors 210, as described above. For example, each cylinder 202 may be associated with a respective duct structure 230 and a respective sensor 210. Although the duct unclogging system 300 may include multiple fuel injectors 116, multiple cylinders 202, multiple duct structures 230, and multiple sensors 210, the description to follow is described in terms of a single fuel injector 116 for a single cylinder 202 that includes a duct structure 230 and a sensor 210.

The duct unclogging system 300 may include the controller 102, as described herein. The controller 102 may be operatively coupled to the fuel pump 104, the fuel injector 116, the sensor 210, and/or the one or more valves 305. The controller 102 may be configured to perform a duct unclogging procedure for the ducts 232 of the duct structure 230, as described below.

The controller 102 may be configured to monitor a pressure in the cylinder 202 (e.g., in the combustion chamber 212 of the cylinder 202). For example, the controller 102 may monitor the pressure in the cylinder 202 continuously, at regular intervals, at irregular intervals, or the like, during operation of the engine 200. The controller 102, to monitor the pressure in the cylinder 202, may receive a signal indicative of the pressure in the cylinder 202 via the sensor 210. Accordingly, based on monitoring the pressure in the cylinder 202 (e.g., based on receiving the signal), the controller 102 may obtain pressure information relating to the pressure in the cylinder 202.

Additionally, or alternatively, the controller 102 may monitor a different parameter and/or another component of the engine 200 (e.g., to obtain pressure information, temperature information, or the like). For example, the controller 102 may monitor a temperature of the cylinder 202 (e.g., and may inferentially determine the pressure based on the temperature), may monitor a temperature at an exhaust port of the engine 200 (e.g., and may inferentially determine the pressure based on the temperature), may monitor torque of a crank (e.g., and may inferentially determine the pressure based on the torque), or the like. In such cases, the controller 102 may receive, via a temperature sensor (e.g., a thermocouple) and/or a torque sensor, one or more signals. Here, the one or more signals may be considered as being indicative of the pressure, since the signals may be used to derive a pressure estimate.

The controller 102 may be configured to obtain data indicative of heat release in the cylinder 202 (e.g., in the combustion chamber 212 of the cylinder 202). In one example, the controller 102 may obtain the data indicative of heat release based on a signal received from a heat sensor (e.g., a heat flux sensor) coupled to the cylinder 202. In another example, the controller 102 may obtain the data indicative of heat release by generating the data indicative of heat release. For example, the controller 102 may generate the data indicative of heat release based on the pressure information (e.g., based on the signal indicative of the pressure). The data indicative of heat release may relate to a heat release rate in the cylinder 202 over a time period, such as over a combustion cycle or between fuel discharges of the fuel injector 116 (e.g., which may be expressed as the heat release (in joules (J)) over a range of crank angle degrees, such as a range from −20 degrees to 5 degrees after TDC (ATDC)). The data indicative of heat release may also relate to a total heat release over a time period, such as over a combustion cycle or between fuel discharges.

In some implementations, the data indicative of heat release may relate to the pressure in the cylinder 202, as described above. That is, data relating to the pressure in the cylinder 202 may be considered as indicative of heat release in the cylinder 202, since the pressure may be used to derive the heat release rate or total heat release. In some implementations, the data indicative of heat release may relate to temperature in the cylinder 202, temperature at an exhaust port of the engine 200, or the like, as described above.

The data indicative of heat release may indicate one or more metrics that can be used to assess whether clogging is present in the ducts 232. The one or more metrics may include a heat release rate in the cylinder 202 over one or more time periods. For example, a metric may include a heat release rate in the cylinder during a time period immediately following fuel injection. In this time period, an unclogged duct 232 may be associated with a negative heat release rate (e.g., due to a cooling effect caused by evaporation of injected fuel) that is below a threshold (e.g., a threshold value), whereas a clogged duct 232 may be associated with a negative heat release rate that is above the threshold (e.g., the clogged duct 232 produces less fuel evaporation in the cylinder 202). As another example, a metric may include a heat release rate in the cylinder during a time period associated with low temperature combustion (e.g., combustion between about 500 Kelvin (K) to about 750 K). In this time period, an unclogged duct 232 may be associated with a heat release rate that is above a threshold, whereas a clogged duct 232 may be associated with a heat release rate that is below the threshold (e.g., the clogged duct 232 has a lower heat release rate from low temperature combustion).

The one or more metrics may include a peak heat release rate in the cylinder 202 during a time period, such as during a combustion cycle or between discharges of the fuel injector 116. An unclogged duct 232 may be associated with a peak heat release rate that is above a threshold, whereas a clogged duct 232 may be associated with a peak heat release rate that is below the threshold (e.g., the clogged duct 232 produces sub-optimal combustion). The one or more metrics may include a total heat release over a time period (e.g., the integrated heat release), such as over a combustion cycle or between discharges of the fuel injector 116. An unclogged duct 232 may be associated with a total heat release that is above a threshold, whereas a clogged duct 232 may be associated with a total heat release that is below the threshold (e.g., the clogged duct 232 produces less heat release).

The controller 102 may be configured to determine whether the data indicative of heat release in the cylinder 202 is indicative of clogging of the ducts 232. For example, the controller 102 may determine whether one or more of the metrics, associated with the data indicative of heat release, satisfy a threshold. In other words, in some examples, the data indicative of heat release is indicative of clogging if one or more of the metrics satisfy a threshold. Clogging of a duct 232 may indicate that incomplete combustion residual buildup in the duct 232 is restricting passage of a fuel jet through the duct 232. Thus, as used herein, "clogging" of a duct 232 can refer to complete clogging of the duct 232, or a partial clogging of the duct 232, that results in a level of fluid restriction through the duct 232 that causes engine conditions that do not meet a set of target engine conditions. Similarly, as used herein, "unclogging" of a duct 232 can refer to complete unclogging of the duct 232, or a partial unclogging of the duct 232, that reduces a level of restriction through the duct 232 to cause engine conditions that meet a set of target engine conditions.

In one example, the controller 102 may determine that a metric relating to total heat release satisfies a threshold (e.g., the total heat release is below the threshold). Satisfaction of this condition alone may be indicative of clogging of the ducts 232. In another example, the controller 102 may determine that a metric relating to peak heat release satisfies a threshold (e.g., the peak heat release is below the threshold). Similarly, satisfaction of this condition alone may be indicative of clogging of the ducts 232. In some examples, the controller 102 may determine that a first metric relating to heat release rate during a first time period (e.g., a time period immediately following fuel injection) satisfies a first threshold; determine that a second metric relating to heat release rate during a second time period (e.g., a time period associated with low temperature combustion) satisfies a second threshold; determine that a third metric relating to peak heat release rate satisfies a third threshold; and/or determine that a fourth metric relating to total heat release satisfies a fourth threshold value. Here, satisfaction of multiple of these conditions (e.g., all of the conditions) may be indicative of clogging of the ducts 232.

The controller 102 may determine that the data indicative of heat release is not indicative of clogging. For example, the controller 102 may determine that one or more of the metrics do not satisfy a threshold (e.g., respective thresholds). Here, the controller 102 may continue to monitor the pressure in the cylinder 202, as described herein, without performing an operation to reduce clogging of the ducts 232.

Alternatively, the controller 102 may determine that the data indicative of heat release is indicative of clogging. For example, the controller 102 may determine that one or more of the metrics satisfy a threshold (e.g., respective thresholds). The controller 102 may determine to perform an operation to reduce clogging of the ducts 232 if the data indicative of heat release is indicative of clogging (e.g., if at least one of the metrics satisfies a threshold).

In some implementations, the controller 102 may be configured to determine whether other data is indicative of clogging of the ducts 232. For example, the controller 102 may determine whether temperature data associated with a cylinder 202 and/or an exhaust port of the engine 200 is indicative of clogging of the ducts 232. As an example, the controller 102 may determine that the temperature data is indicative of clogging if a peak temperature satisfies a threshold, if an average temperature satisfies a threshold, and/or if a rate of temperature change satisfies a threshold value.

The controller 102 may be configured to perform the operation to reduce clogging of the one or more ducts 232. For example, the controller 102 may perform the operation based on determining that the data indicative of heat release is indicative of clogging. As another example, the controller 102 may perform the operation based on determining that one or more metrics associated with the data indicative of heat release satisfy a threshold. The operation may include causing a pressure of fuel that is supplied to the fuel injector 116 to increase (e.g., relative to a pressure being used when the controller 102 determined that the data is indicative of clogging) and/or causing a peak temperature (or an average temperature) in the cylinder 202 to increase (e.g., relative to a peak temperature in the cylinder 202 during a combustion cycle when the controller determined that the data is indicative of clogging). In some implementations, the operation may include both of causing the pressure of fuel that is supplied to the fuel injector 116 to increase and causing the peak temperature in the cylinder 202 to increase. Here, the controller 102 may perform the operations concurrently and/or may perform the operations in a pattern (e.g., in alternating cycles).

The controller 102, to cause the pressure of fuel that is supplied to the fuel injector 116 to increase, may provide a control signal to the fuel pump 104 that causes the fuel pump 104 to increase the pressurization of fuel. This, in turn, causes the pressure in the fuel rail 112 to increase, thereby causing the pressure of fuel that is supplied to the fuel injector 116 to increase. The controller 102 may cause (e.g., using pressure sensor 114) the pressure of fuel that is supplied to the fuel injector 116 to increase to a target pressure or to increase by a particular amount (e.g., increase by 5%, 10%, 15%, 20%, or the like). By increasing the pressure of fuel that is supplied to the fuel injector 116, the fuel injector 116 may discharge fuel with greater force and velocity. This additional fueling momentum may remove incomplete combustion residual buildup in the ducts 232. In some implementations, to cause the pressure of fuel that is supplied to a unit injector to increase, the controller 102 may provide a control signal to the unit injector that causes a pump of the unit injector to increase the pressurization of fuel.

The controller 102, to cause the peak temperature in the cylinder 202 to increase, may advance an injection timing of the fuel injector 116 (e.g., relative to a timing being used when the controller 102 determined that the data is indicative of clogging). The controller 102, to advance the injection timing, may adjust the timing by which the controller 102 provides control signals to a fuel injector 116. For example, to advance the injection timing, the controller 102 may adjust the injection timing from using a first value of degrees before TDC (BTDC) to using a second value of degrees BTDC, so that an ignition event occurs relatively earlier in a combustion cycle. The controller 102 may advance the injection timing to a target injection timing or advance the injection timing by a particular amount (e.g., advance by 1 degree, 2 degrees, or the like). By advancing the injection timing, higher peak temperatures may be achieved in the cylinder 202. The higher peak temperatures may promote oxidizing of incomplete combustion residuals in the ducts 232, thereby removing the incomplete combustion residuals from the ducts 232.

Additionally, or alternatively, to cause the peak temperature in the cylinder 202 to increase, the controller 102 may cause actuation of an aftercooler bypass valve 305 to cause bypass of the aftercooler. By bypassing the aftercooler, hotter air is supplied to the engine 200, thereby increasing peak in-cylinder temperatures to promote oxidizing of incomplete combustion residuals, as described above. Additionally, or alternatively, to cause the peak temperature in the cylinder 202 to increase, the controller 102 may cause actuation of an EGR control valve 305 to cause reduction or cessation of EGR. By reducing or ceasing EGR, combustion heat is increased, thereby increasing peak in-cylinder temperatures to promote oxidizing of incomplete combustion residuals, as described above. Additionally, or alternatively, to cause the peak temperature in the cylinder 202 to increase, the controller 102 may cause actuation of an EGR cooler bypass valve 305 to cause bypass of the EGR cooler. By bypassing the EGR cooler, hotter exhaust gas is recirculated to the engine 200, thereby increasing peak in-cylinder temperatures to promote oxidizing of incomplete combustion residuals, as described above.

In some implementations, to cause the peak temperature in the cylinder 202 to increase, the controller 102 may cause a load on the engine 200 to increase, cause an output torque of the engine 200 to increase, or the like. Moreover, to cause the peak temperature in the cylinder 202 to increase, the controller 102 may cause adjustment of (e.g., an increase of) boost pressure to the engine 200. Additionally, to cause the peak temperature in the cylinder 202 to increase, the controller 102 may cause adjustment of actuation timing of an intake valve 305 and/or an exhaust valve 305 (e.g., the controller 102 may perform variable valve actuation). By adjusting valve timings, in-cylinder residuals may be increased, thereby increasing in-cylinder temperatures.

While performing the operation, the controller 102 may continue to obtain the data indicative of heat release in the cylinder 202, in a similar manner as described above. The controller 102 may perform the operation until the data indicative of heat release is indicative of a reduction of clogging of the ducts 232 (e.g., indicative of unclogging of the ducts 232). For example, the controller 102 may perform the operation until one or more of the metrics associated with the data indicative of heat release no longer satisfy a threshold, as described above. As an example, if the controller 102 initiated the operation based on a metric exceeding a threshold, the controller 102 may discontinue the operation based on the metric falling below the threshold. In some implementations, the controller 102 may perform the operation until one or more of the metrics associated with the data indicative of heat release satisfy a different threshold (e.g., different from a threshold used for initiating the operation). For example, if the controller 102 initiated the operation based on a metric exceeding a first threshold, the controller 102 may discontinue the operation based on the metric falling below a second threshold (e.g., that is lower than the first threshold). Thereafter, the controller 102 may perform the operation, as needed, as described above.

As indicated above, FIG. 3 is provided as an example. Other examples may differ from what is described with regard to FIG. 3.

Figure 4:
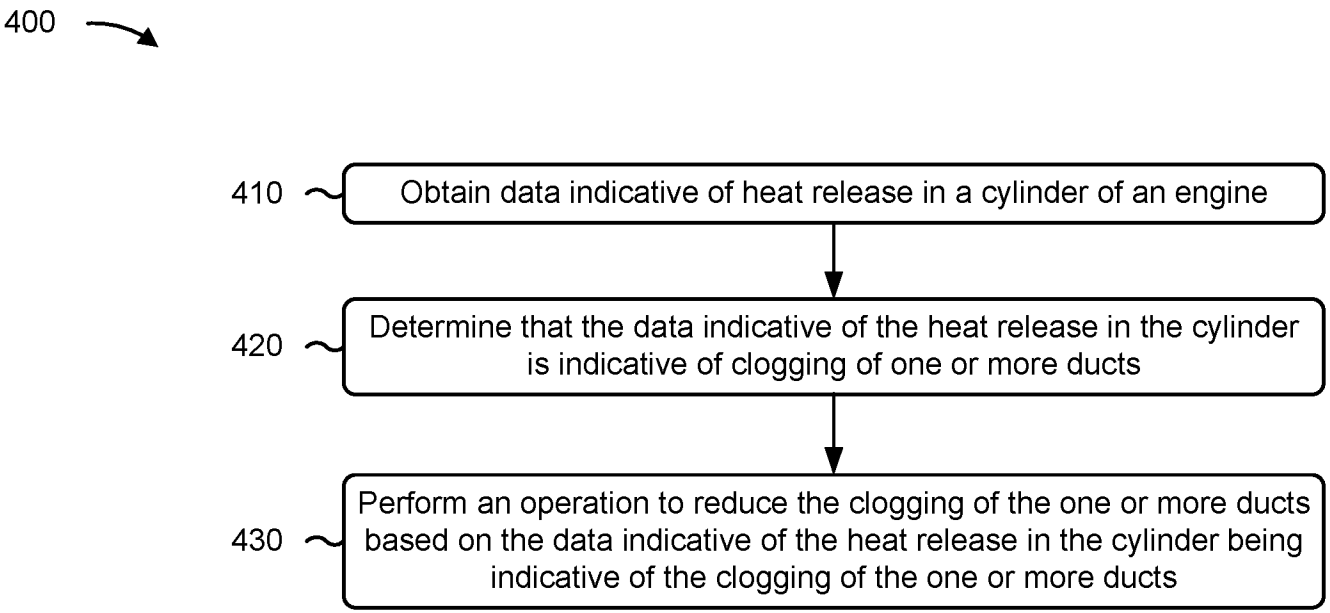
FIG. 4 is a flowchart of an example process relating to unclogging of ducts for fuel injection.

FIG. 4 is a flowchart of an example process 400 associated with unclogging of ducts for fuel injection. One or more process blocks of FIG. 4 may be performed by a controller (e.g., controller 102). Additionally, or alternatively, one or more process blocks of FIG. 4 may be performed by another device or a group of devices separate from or including the controller, such as another device or component that is internal or external to a machine that includes the engine 200.

As shown in FIG. 4, process 400 may include obtaining data indicative of heat release in a cylinder of an engine (block 410). For example, the controller may obtain data indicative of heat release in a cylinder of an engine, as described above. The engine may include a fuel injector having one or more orifices to discharge fuel, and a duct structure including one or more ducts configured to provide respective passages for fuel discharged from the one or more orifices of the fuel injector to the cylinder of the engine, as described above. The data indicative of the heat release in the cylinder may relate to a heat release rate in the cylinder and/or a pressure in the cylinder.

Obtaining the data indicative of the heat release in the cylinder may include monitoring a pressure in the cylinder to obtain pressure information, and generating the data indicative of the heat release in the cylinder based on the pressure information. For example, process 400 may include receiving, via a sensor, a signal indicative of a pressure in the cylinder, and generating the data indicative of the heat release in the cylinder based on the signal. The data indicative of the heat release in the cylinder may indicate one or more metrics that include one or more of a heat release rate in the cylinder during one or more time periods, a peak heat release rate in the cylinder, or a total heat release in the cylinder.

As further shown in FIG. 4, process 400 may include determining that the data indicative of the heat release in the cylinder is indicative of clogging of one or more ducts (block 420). For example, the controller may determine that the data indicative of the heat release in the cylinder is indicative of clogging of the one or more ducts, as described above.

The data indicative of the heat release in the cylinder may be indicative of the clogging of the one or more ducts if one or more metrics associated with the data satisfy a threshold. For example, determining that the data indicative of the heat release in the cylinder is indicative of clogging may include at least one of: determining that a first metric relating to a heat release rate during a first time period satisfies a first threshold; determining that a second metric relating to a heat release rate during a second time period satisfies a second threshold; determining that a third metric relating to a peak heat release rate satisfies a third threshold; or determining that a fourth metric relating to total heat release satisfies a fourth threshold.

As further shown in FIG. 4, process 400 may include performing an operation to reduce the clogging of the one or more ducts based on the data indicative of the heat release in the cylinder being indicative of the clogging of the one or more ducts (block 430). For example, the controller may perform an operation to reduce the clogging of the one or more ducts, as described above. The operation may include at least one of causing a pressure of fuel that is supplied to a fuel injector to increase, or causing a peak temperature in the cylinder to increase. Causing the peak temperature in the cylinder to increase may include at least one of advancing an injection timing for the fuel injector, actuating an aftercooler bypass valve, actuating an EGR cooler bypass valve, actuating an EGR control valve, or adjusting an actuation timing of at least one of an intake valve or an exhaust valve of the cylinder.

The operation may include both of causing the pressure of fuel that is supplied to the fuel injector to increase and causing the peak temperature in the cylinder to increase. The operation may include causing the pressure of fuel that is supplied to the fuel injector to increase to a target pressure. Causing the pressure of fuel that is supplied to the fuel injector to increase may include causing a fuel pump to increase pressurization of fuel. The operation may be performed until the data indicative of the heat release in the cylinder is indicative of a reduction of the clogging of the one or more ducts. For example, the operation may be performed until the one or more metrics satisfy a different threshold.

Although FIG. 4 shows example blocks of process 400, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

The duct unclogging system 300 described herein can be used with any machine that utilizes an internal combustion engine. In particular, the duct unclogging system 300 can be used with an engine 200 that utilizes duct structures 230 in cylinders 202 of the engine 200. As described above, the ducts 232 may clog with incomplete combustion residuals during operation of the engine 200, which can degrade engine performance.

The duct unclogging system 300 described herein may detect clogging of the ducts 232 and may implement one or more operations to remediate the clogging. The duct unclogging system 300 may detect the clogging and implement the operations automatically without operator input. As described above, the operations can include increasing the pressure supplied to the fuel injectors 116 (e.g., by increasing the pressure in the fuel rail 112), which increases the force and velocity of discharged fuel to wear off incomplete combustion residuals deposited in the ducts 232. Additionally, the operations can include increasing a peak temperature in the cylinder 202 (e.g., by advancing injection timing), which increases heat in the cylinder 202 to promote oxidation of the incomplete combustion residuals deposited in the ducts 232.

The operations provide fast and effective clogging remediation during normal engine operation and without operator input. Accordingly, the duct unclogging system 300 restores engine performance of a machine in real time without disrupting an operator of the machine and/or disrupting work performed by the machine.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

As used herein, satisfying a threshold may, depending on the context, refer to a value being greater than the threshold, greater than or equal to the threshold, less than the threshold, less than or equal to the threshold, equal to the threshold, not equal to the threshold, or the like.

What is claimed is:

1. A system, comprising:

a fuel injector of an engine, the fuel injector having one or more orifices to discharge fuel;

a duct structure including one or more ducts configured to provide respective passages for fuel discharged from the one or more orifices of the fuel injector to a cylinder of the engine; and a controller configured to:

obtain data indicative of heat release in the cylinder;

determine that one or more metrics associated with the data indicative of the heat release in the cylinder satisfy a threshold; and perform an operation to reduce clogging of the one or more ducts based on the one or more metrics satisfying the threshold, the operation including at least one of:

causing a pressure of fuel that is supplied to the fuel injector to increase, or causing a peak temperature in the cylinder to increase.

2. The system of claim 1, wherein causing the peak temperature in the cylinder to increase comprises advancing an injection timing for the fuel injector.

3. The system of claim 1, wherein the controller is configured to perform the operation until the one or more metrics satisfy a different threshold.

4. The system of claim 1, further comprising:

a sensor configured to detect a pressure in the cylinder.

5. The system of claim 1, wherein the controller is further configured to:

receive, via a sensor, a signal indicative of a pressure in the cylinder.

6. The system of claim 5, wherein the controller, to obtain the data indicative of the heat release in the cylinder, is configured to:

generate the data indicative of the heat release in the cylinder based on the signal indicative of the pressure in the cylinder.

7. The system of claim 1, wherein the one or more metrics of the data indicative of the heat release in the cylinder include one or more of:

a heat release rate in the cylinder during one or more time periods, a peak heat release rate in the cylinder, or a total heat release in the cylinder.

8. The system of claim 1, wherein the controller, to determine that the one or more metrics satisfy the threshold, is configured to at least one of:

determine that a first metric relating to a heat release rate during a first time period satisfies a first threshold;

determine that a second metric relating to a heat release rate during a second time period satisfies a second threshold;

determine that a third metric relating to a peak heat release rate satisfies a third threshold; or determine that a fourth metric relating to total heat release satisfies a fourth threshold.

9. A method, comprising:

obtaining, by a controller, data indicative of heat release in a cylinder of an engine, the engine including a fuel injector having one or more orifices to discharge fuel, and a duct structure including one or more ducts configured to provide respective passages for fuel discharged from the one or more orifices of the fuel injector to the cylinder of the engine;

determining, by the controller, that the data indicative of the heat release in the cylinder is indicative of clogging of the one or more ducts; and performing, by the controller, an operation to reduce the clogging of the one or more ducts based on the data indicative of the heat release in the cylinder being indicative of the clogging of the one or more ducts, the operation including at least one of:

causing a pressure of fuel that is supplied to the fuel injector to increase, or causing a peak temperature in the cylinder to increase.

10. The method of claim 9, wherein the data indicative of the heat release in the cylinder is indicative of the clogging of the one or more ducts if one or more metrics associated with the data satisfy a threshold.

11. The method of claim 9, wherein the data indicative of the heat release in the cylinder indicates one or more metrics that include one or more of:

a heat release rate in the cylinder during one or more time periods, a peak heat release rate in the cylinder, or a total heat release in the cylinder.

12. The method of claim 9, wherein the operation is performed until the data indicative of the heat release in the cylinder is indicative of a reduction of the clogging of the one or more ducts.

13. The method of claim 9, wherein obtaining the data indicative of the heat release in the cylinder comprises:

monitoring a pressure in the cylinder to obtain pressure information; and generating the data indicative of the heat release in the cylinder based on the pressure information.

14. The method of claim 9, wherein causing the peak temperature in the cylinder to increase comprises at least one of:

advancing an injection timing for the fuel injector, actuating an aftercooler bypass valve, actuating an exhaust gas recirculation cooler bypass valve, actuating an exhaust gas recirculation control valve, or adjusting an actuation timing of at least one of an intake valve or an exhaust valve of the cylinder.

15. A machine, comprising:

an engine including a cylinder;

a fuel injection system including a fuel injector having one or more orifices to discharge fuel;

a duct structure, disposed in the cylinder, including one or more ducts configured to provide respective passages for fuel discharged from the one or more orifices of the fuel injector to the cylinder; and a controller configured to:

obtain data indicative of heat release in the cylinder;

determine that the data indicative of the heat release in the cylinder is indicative of clogging of the one or more ducts; and perform an operation to reduce the clogging of the one or more ducts based on the data indicative of the heat release in the cylinder being indicative of the clogging of the one or more ducts, the operation including:

causing a pressure of fuel that is supplied to the fuel injector to increase, or causing a peak temperature in the cylinder to increase.

16. The machine of claim 15, causing the peak temperature in the cylinder to increase comprises at least one of:

advancing an injection timing for the fuel injector, actuating an aftercooler bypass valve, actuating an exhaust gas recirculation cooler bypass valve, actuating an exhaust gas recirculation control valve, or adjusting an actuation timing of at least one of an intake valve or an exhaust valve of the cylinder.

17. The machine of claim 15, wherein the data indicative of the heat release in the cylinder indicates one or more metrics that include one or more of:

a heat release rate in the cylinder during one or more time periods, a peak heat release rate in the cylinder, or a total heat release in the cylinder.

18. The machine of claim 15, wherein obtaining the data indicative of the heat release in the cylinder comprises:

monitoring a pressure in the cylinder to obtain pressure information; and generating the data indicative of the heat release in the cylinder based on the pressure information.

19. The machine of claim 15, wherein the data indicative of the heat release in the cylinder relates to heat release rate in the cylinder.

20. The machine of claim 15, wherein the data indicative of the heat release in the cylinder relates to pressure in the cylinder.

* * * * *